US006786285B2

(12) United States Patent
Johnson et al.

(10) Patent No.: US 6,786,285 B2
(45) Date of Patent: Sep. 7, 2004

(54) FLOW CONTROL REGULATION METHOD AND APPARATUS

(75) Inventors: Craig D. Johnson, Montgomery, TX (US); Gary Martin Oddie, St. Neots (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/167,895

(22) Filed: Jun. 12, 2002

(65) Prior Publication Data

US 2002/0189815 A1 Dec. 19, 2002

Related U.S. Application Data

(60) Provisional application No. 60/297,706, filed on Jun. 12, 2001.

(51) Int. Cl.[7] ..... E21B 43/16; E21B 34/08

(52) U.S. Cl. ..... 166/370; 166/50; 166/373; 166/66.6; 166/250.15

(58) Field of Search ..... 166/50, 66.6, 54.1, 166/205, 250.15, 370, 373, 374, 386

(56) References Cited

U.S. PATENT DOCUMENTS

| | | | | |
|---|---|---|---|---|
| 2,018,283 | A | 10/1935 | Schweitzer et al. | |
| 2,597,554 | A | 5/1952 | West | |
| 2,623,595 | A | 12/1952 | West | |
| 2,804,926 | A | 9/1957 | Zublin | |
| 3,626,479 | A | * 12/1971 | Properzi | 164/414 |
| 3,741,300 | A | 6/1973 | Wolff et at. | |
| 4,714,117 | A | 12/1987 | Dech | |
| 4,901,796 | A | 2/1990 | Drnevich | |
| 5,004,049 | A | 4/1991 | Arterbury | |
| 5,107,927 | A | 4/1992 | Whiteley et al. | |
| 5,165,476 | A | 11/1992 | Jones | |
| 5,170,753 | A | 12/1992 | Sato | |
| 5,174,379 | A | 12/1992 | Whiteley et al. | |
| 5,269,376 | A | 12/1993 | Gadelle et al. | |
| 5,355,953 | A | 10/1994 | Shy et al. | |
| 5,375,661 | A | 12/1994 | Daneshy et al. | |
| 5,435,393 | A | 7/1995 | Brekke et al. | |
| 5,551,513 | A | 9/1996 | Surles et al. | |
| 5,624,560 | A | 4/1997 | Voll et al. | |
| 5,642,781 | A | 7/1997 | Richard | |
| 5,730,223 | A | 3/1998 | Restarick | |
| 5,803,179 | A | 9/1998 | Echols et al. | |
| 5,849,188 | A | 12/1998 | Voll et al. | |
| 5,890,533 | A | 4/1999 | Jones | |
| 5,896,928 | A | 4/1999 | Coon | |
| 5,906,238 | A | 5/1999 | Carmody et al. | |
| 5,980,745 | A | 11/1999 | Voll et al. | |
| 6,006,829 | A | 12/1999 | Whitlock et al. | |
| 6,112,815 | A | 9/2000 | Boe et al. | |
| 6,112,817 | A | 9/2000 | Voll et al. | |
| 6,298,916 | B1 | 10/2001 | Tibbles et al. | |
| 6,343,651 | B1 | 2/2002 | Bixenman | |
| 6,371,210 | B1 | * 4/2002 | Bode et al. | 166/370 |
| 6,619,402 | B1 | * 9/2003 | Amory et al. | 166/370 |

FOREIGN PATENT DOCUMENTS

| | | |
|---|---|---|
| GB | 2325949 | 9/1998 |
| WO | WO 92/08875 | 5/1992 |
| WO | WO 01/11189 | 2/2001 |
| WO | WO 01/65063 | 9/2001 |

OTHER PUBLICATIONS

White and Hoppmann, "Controlling flow in horizontal wells" *World Oil*, Nov., 1991, pp. 73–80.

Dikken, "Pressure Drop in Horizontal Wells and Its Effects on Their Production Performance" SPE 19824, Oct., 1989, pp. 561–574.

"Products: Thin Pack Screens" from http:www.johnson-screens.usfilter.com/p_thin_pack.as, Printed, Aug. 3, 2001.

* cited by examiner

*Primary Examiner*—David Bagnell
*Assistant Examiner*—Shane Bomar
(74) *Attorney, Agent, or Firm*—Robert Van Someren PC; Jeffrey Griffin; Brigitte Jeffery Echols

(57) ABSTRACT

A technique for controlling fluid production in a deviated wellbore is disclosed. The technique utilizes a flow pipe the interior of which is in hydraulic communication with the earth's surface. A plurality of flow control valves are disposed at spaced apart positions along the length of the flow pipe. The flow control valves are used to regulate flow along intervals of the flow pipe.

31 Claims, 5 Drawing Sheets

FLOW CONTROL REGULATION METHOD AND APPARATUS

CROSS REFERENCE TO RELATED APPLICATIONS

The following is based on and claims priority to U.S. Provisional Application No. 60/297,706, filed Jun. 12, 2001.

FIELD OF THE INVENTION

The invention is related generally to the field of petroleum wellbore production control apparatus and methods. More specifically, the invention is related to methods and apparatus for controlling production in a deviated wellbore to reduce the possibility of unwanted gas and/or water coning.

BACKGROUND OF THE INVENTION

Petroleum is produced from an earth formation reservoir when energy stored as pressure in the reservoir fluids is released by exposing the reservoir to a lower pressure in a wellbore drilled through the reservoir. Fluids in the reservoir move into reservoir spaces that were voided by the fluids which moved into the wellbore by expansion against the lower pressure.

Some wellbores are drilled substantially horizontally through certain earth formation reservoirs to increase the wellbore drainage area in the reservoir. Increased drainage area enables the wellbore operator to more efficiently extract petroleum from the reservoir. The typical horizontal wellbore is drilled substantially vertically from the earth's surface, and is deviated to at or near horizontal where the wellbore is intended to pass through a petroleum bearing interval within the subsurface reservoir.

When petroleum is produced into a horizontal wellbore having a substantial lateral extent from the position of the vertical part of the wellbore, fluid flow from the lateral end of the wellbore (the "toe" of the wellbore) is significantly more affected by the friction of fluid flowing inside the wellbore than is the fluid flowing nearer the place at which the wellbore deviates from vertical (the "heel" of the wellbore). As a result of the fluid friction, the pressure drop between the reservoir and the wellbore at the toe is typically less than the pressure drop at the heel. This can result in "coning" into the wellbore of fluids not desired to be produced from the reservoir. Gas disposed above an oil-bearing interval, for example, may cone into the wellbore, or water disposed below an oil bearing or a gas bearing interval in the reservoir may cone into the wellbore. In any case, the possibility of coning reduces the productive capacity of a horizontal wellbore by reducing the overall fluid flow rate which may be attained.

Methods and apparatus known in the art for reducing coning are described, for example in U.S. Pat. No. 5,803,179 issued to Echols and U.S. Pat. No. 5,435,393 issued to Brekke et al. The apparatus known in the art include hydraulically segmenting the exterior of the wellbore along its length in the horizontal section. Each segment is placed into hydraulic communication with the reservoir independently through a flow controlling device having a selected restriction to fluid flow. Typically, the selected flow restriction is more resistant to flow in the controlling devices positioned near the heel of the well, and is lower in the flow control devices positioned near the toe of the well. The purpose of the selected flow restrictions is to more evenly distribute pressure drop between the reservoir and the wellbore along the length of the wellbore. More evenly distributed pressure drop can reduce the possibility of coning.

Most of the apparatus and methods known in the art for controlling flow into a horizontal wellbore rely on fixed flow restrictors. While the restriction provided by each individual flow restrictor can be selected initially to produce a substantially evenly distributed pressure drop along the wellbore, once the apparatus is installed in the wellbore, the restrictions cannot be adjusted. If there are any changes in the character of the fluid flow along the wellbore, the amount of pressure drop at one or more of the fixed flow restrictors may not be suitable for the existing fluid flow to provide an evenly distributed pressure drop along the wellbore. Certain throttling devices also have been proposed to help the flow. Such devices use a spring biased member that moves to restrict flow when the pressure drop increases. Such devices, however, are somewhat limited in compensating for changes in the reservoir. An example of such a character change can be as simple as a change in the total fluid flow rate through the wellbore. Other types of changes in fluid flow character can have similar effects on the ability of prior art apparatus and methods to evenly distribute flow along a horizontal wellbore.

Accordingly, there is a need for an apparatus and method which can evenly distribute flow along a horizontal wellbore and which can respond to changes in the character of flow along the wellbore.

SUMMARY OF THE INVENTION

One aspect of the invention is an apparatus for controlling fluid production in a horizontal wellbore. The apparatus includes a flow pipe the interior of which is in hydraulic communication with the earth's surface. The flow pipe is disposed in a substantially horizontal portion of the wellbore. A plurality of flow control valves are disposed at spaced apart positions along the length of the flow pipe. Each of the valves provides hydraulic communication between the interior of the pipe and a fluid reservoir in an earth formation. Each of the valves is adapted to maintain a substantially constant pressure drop between the reservoir and the interior of the flow pipe.

Other aspects and advantages of the invention will be apparent from the following description and the appended claims.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

Figure 1:
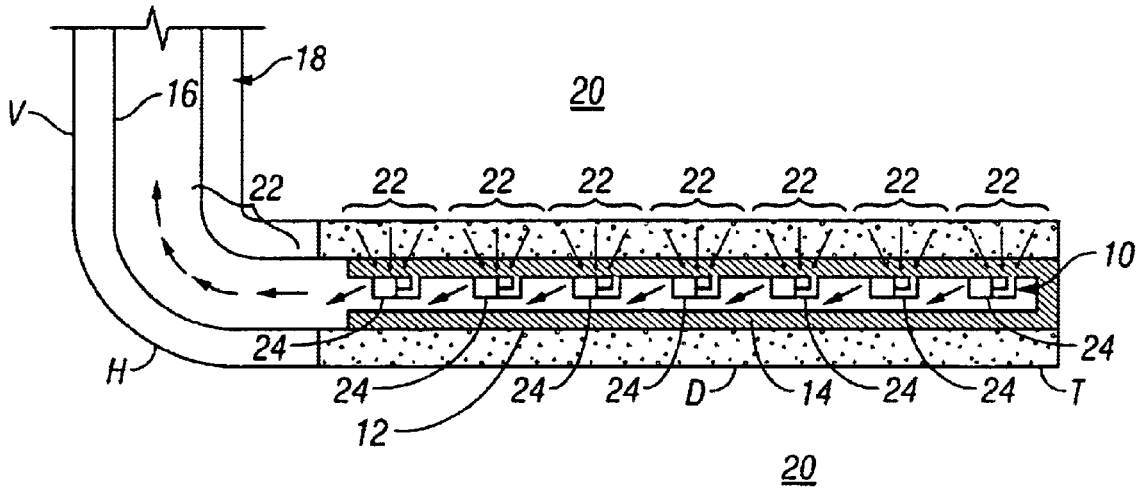
FIG. 1 shows an embodiment of an apparatus according to the invention in general form.

An example of a production control apparatus according to one aspect of the invention is shown in FIG. 1. A wellbore 18 is drilled from the earth's surface, and can include a substantially vertical section V therefrom and a deviated section D. In this example, section D deviates to horizontal (or near horizontal) through a petroleum bearing interval, labeled formation reservoir 20. The horizontal section of the wellbore 18 can be generally described as beginning at a heel H and ending at a toe T.

A production control apparatus 10 is disposed inside the wellbore 18 in the horizontal section. The production control apparatus 10 is in fluid communication with a production tubing 16 disposed inside the wellbore 18. The tubing 16 is in hydraulic communication with the earth's surface, usually through at least one valve (not shown).

In this example, the production control apparatus 10 includes a flow pipe 12 which may be a segment of solid pipe, coupled segments of solid pipe, a sand control screen or the like. The pipe 12 is disposed inside a gravel pack 14 in this example, but it should be understood that a production control apparatus according to the invention may be used with other types of wellbore completions as well as with or without gravel packs. For example, a series of packers could be disposed between flow pipe 12 and the wall of the wellbore to limit axial flow along pipe 12.

The combination of the gravel pack 14 and flow pipe 12 in this example also is intended to reduce movement of solid material from the reservoir 20 into the wellbore 18 while allowing fluid to flow relatively unimpeded from the reservoir 20 into the wellbore 18. Fluid communication between the exterior of the pipe 12 and the interior thereof is established through a plurality of flow control valves 24 disposed at selected spaced apart positions along the length of the flow pipe 12. Fluid flow from the reservoir 20 into pipe 12, and then into the tubing, as indicated by arrows 22, is regulated by the flow control valves 24 in a manner which will be further explained. Valves 24 may be located inside or outside of flow pipe 12, and may be located in the horizontal or vertical portions of the wellbore.

Figure 2:
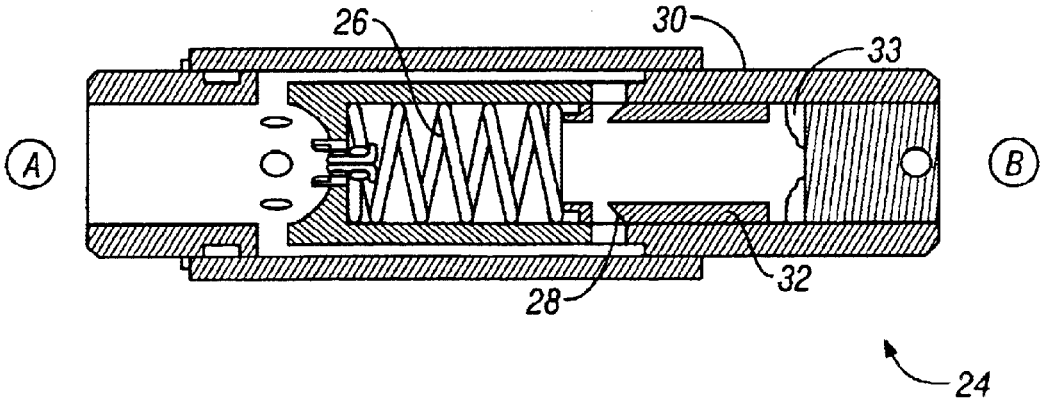
FIG. 2 shows in more detail one example of a flow control valve used in an apparatus according to FIG. 1.

An exemplary style of flow control valve 24 is shown in more detail in FIG. 2. In this example, the valve 24 includes a piston 32 disposed inside a housing 30. The housing has a fluid inlet port B and a fluid discharge port A. Fluid inlet port B is in communication with the reservoir (20 in FIG. 1) and fluid discharge port A is in fluid communication with the interior of the flow pipe (12 in FIG. 1). A spring or other biasing mechanism 26 pushes on the piston 32 to expose fluid transfer ports 28 which connect the inlet port B with the discharge port. As fluid flow through the valve 24 increases, the piston 32 is moved by the force of the flow, acting on the piston surface 33, to close the transfer ports 28, which reduces the flow. Flow control valve 24 acts to maintain a substantially constant flow rate from inlet port B to discharge port A irrespective of the difference in pressure between inlet port B and discharge port A.

Instead of including a piston 32, the valve 24 of FIG. 2 may include a diaphragm (not shown) which functions similarly and for the same purpose as piston 32.

The exemplary flow control valve shown in FIG. 2 is not the only type of flow control valve which may be used in an apparatus according to the invention. Other types of flow control valves can be used with certain embodiments of the invention to maintain a substantially constant pressure drop and/or to maintain a desired flow rate even when the inlet and/or discharge pressure across the valve changes. These types of flow control valves when used in a production control apparatus for horizontal wells offer greater flow control than conventional fixed orifice style devices. As will be appreciated by those skilled in the art, a fixed orifice provides a flow rate which is proportional to the difference in pressure across the orifice.

Figure 3:
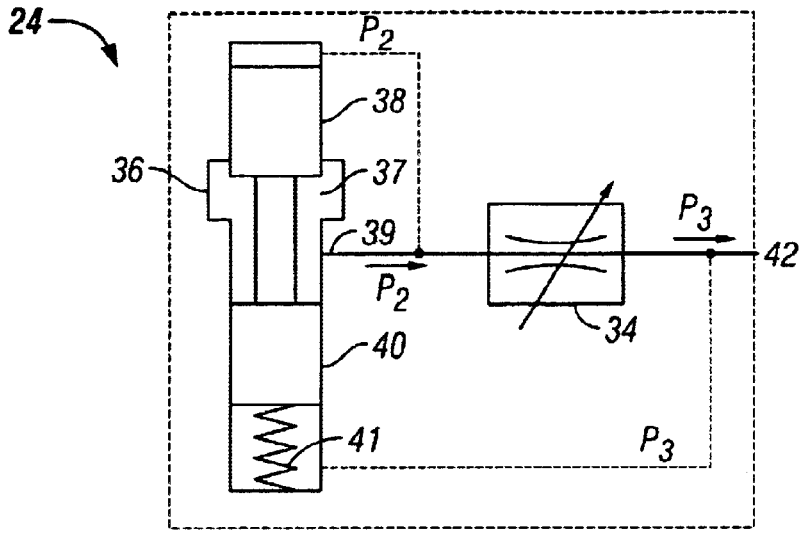
FIG. 3 shows another example of a flow control valve used in an apparatus according to the invention.

An alternative type of flow control valve 24 is shown in FIG. 3. Fluid inlet 36 is in hydraulic communication with the reservoir (20 in FIG. 1). Fluid outlet 42 is in hydraulic communication with the interior of the pipe (12 in FIG. 1). Fluid enters from the inlet 36 and passes into a chamber 37. The chamber 37 is bounded by a first piston 38 in hydraulic communication on one side with the inlet 36 and on the other side with a transfer port 39 at the outlet of the chamber 37. The first piston 38 is adapted to close the transfer port 39 when the first piston 38 moves in one direction. The first piston 38 is mechanically coupled to a second piston 40 which is in hydraulic communication on one side with the chamber 37 and on the other side to the outlet 42. The second piston 40 is coupled to a spring 41 or other biasing mechanism which tends to move the pistons 38, 40 to open the transfer port 39. The transfer port 39 is coupled to the outlet 42 through a throttle or orifice, shown generally at 34.

Changes in fluid flow rate across the throttle 34 result in changes in differential pressure across the throttle. These pressure changes are communicated to the sides of the first 38 piston and second piston 40, shown respectively at P2 and P3, so that the pistons 38, 40 move against spring pressure to close the transfer port 39 when the flow rate increases. The pistons 38, 40 move to open the transfer port when the pressure differential (P2–P3) reduces as the flow rate decreases. The operation of the pistons 38, 40 with respect to the transfer port 39 provides a substantially constant differential pressure across the throttle 34, and as a result, between inlet 36 and outlet 42.

Other types of flow control valves may include an electrical type differential pressure sensor coupled to a controller which operates an electrically controlled valve. Accordingly, it should be understood that the valves shown in FIGS. 2 and 3 are not the only types which can be used in any particular embodiment of the invention.

In a production control apparatus according to the invention, each flow control valve 24, illustrated in FIG. 1, provides a substantially constant pressure drop between the interior of the flow pipe 12 and the exterior of the flow pipe, irrespective of the absolute pressure at the interior or exterior of the basepipe at the position of each valve. Maintaining a substantially constant pressure drop across each valve helps ensure that the fluid flow rate across each flow control valve remains substantially constant, irrespective of pressure changes inside the flow pipe. Because the fluid flow rate across each flow control valve is maintained substantially constant, the total flow rate from the wellbore (18 in FIG. 1) may be changed (such as by operating a valve at the earth's surface) while still having a substantially even distribution of fluid flow along the length of the wellbore. The invention therefore can provide an improvement over prior art flow regulation systems. Prior art systems tended to be designed for a particular fluid pressure differential across the flow control device, and changes in the actual pressure differential could upset the distribution of fluid flow from the reservoir.

Figure 4:
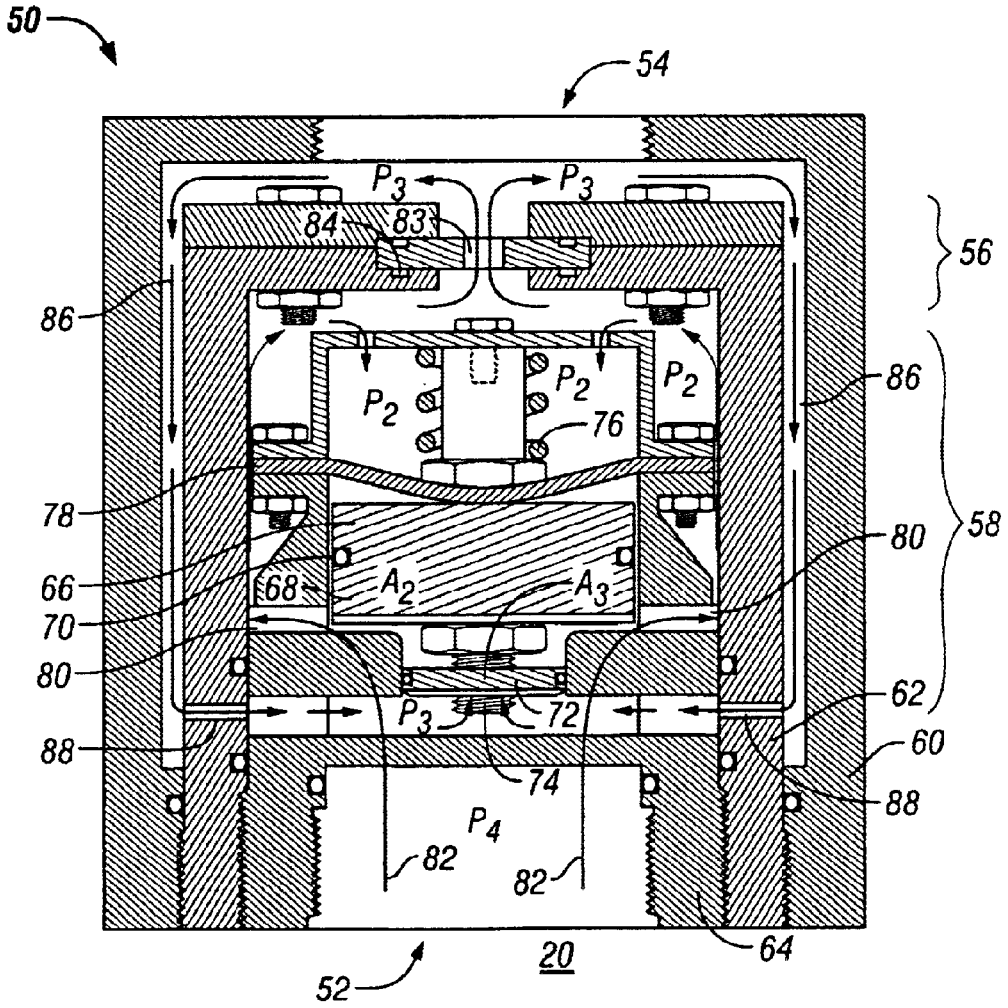
FIG. 4 is a cross-sectional view of a valve for regulating flow.

Referring generally to FIG. 4, another exemplary flow control valve 50 is illustrated. Flow control valve 50 may be mounted at least substantially external to flow pipe 12 or substantially internal to flow pipe 12. Valve 50 comprises an upstream or formation end 52 and a downstream end 54 in communication with the interior of pipe 12. Additionally, flow control valve 50 comprises a throttle region 56 and a pressure regulating region or device 58.

In this specific example, flow control valve 50 functions substantially as the valve schematically illustrated in FIG. 3. Exemplary components of flow control valve 50 comprise an outer housing 60 surrounding an intermediate housing 62. An inner housing 64 is disposed within intermediate housing 62, and a housing valve 66 is slidably disposed within inner housing 64. Housing valve 66 comprises a piston 68 slidably received within an appropriately sized opening within inner housing 64. A seal member 70 is disposed between the outer circumferential surface of piston 68 and the corresponding interior surface of inner housing 64. Piston 68 is coupled to a secondary piston 72 by a rod 74. Secondary piston 72 has a smaller diameter than piston 68 and slides within a smaller opening in inner housing 64.

Piston 68 is biased in a direction towards valve end 54 by a spring member 76 coupled to piston 68. A membrane 78 is disposed at a position generally between spring member 76 and piston 68 to, for example, prevent the accumulation of debris on piston 68.

Fluid flowing from the reservoir 20 is at a pressure P1 and flows in through valve end 52. The fluid then flows upward (upward when valve 50 is oriented as illustrated in FIG. 4) to flow ports 80 along isolated flow paths (not shown) but indicated by arrows 82. The flow path continues upward from flow ports 80 and the region beneath piston 68 along a flow path between inner housing 64 and intermediate housing 62 to a region above piston 68 to establish a pressure indicated by P2. The flow path continues through an orifice 83 in a diaphragm 84 and establishes a pressure P3 at downstream end 54 of flow control valve 50. This pressure is allowed to act against a bottom of secondary piston 72 via flow paths 86 and cross ports 88 extending through intermediate housing 62.

Piston 68 and secondary piston 72 act as a pressure balancing device which is actually controlled by throttle 56 via throttle diaphragm 84. During operation, the formation pressure P1 may build at reservoir end 52 of flow control valve 50. The pressure P3 is established on an opposite end of the valve inside the flow pipe 12, 50. When either P1 or P3 changes, the pressure differential across ends 52 and 54 also changes and pistons 68 and 72 move to substantially maintain a constant flow rate.

In this example, spring member 76 pushes piston 68 and 72 towards a neutral position when there is no flow through the valve. When there is flow through the valve, the pressures exert a force on piston 68 and secondary piston 72. If a change in pressure at either P1 or P3 results in increased pressure at P2, piston 68 is moved against the bias of spring member 76 and in a direction to further restrict flow ports 80. If, however, the pressure at P2 decreases, piston 68 is moved to further open flow ports 80. Thus, flow control valve 50 is able to automatically regulate the flow from formation 20 into the flow pipe.

Figure 5:
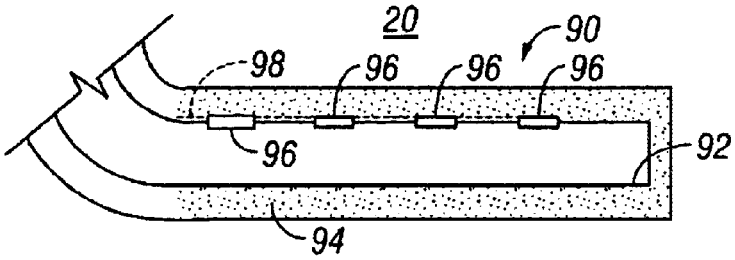
FIG. 5 is a schematic representation of a deviated wellbore and flow control system.

Referring generally to FIG. 5, another type of flow control system, labeled flow control system 90, is illustrated. Flow control system 90 is disposed along a flow pipe 92, such as a basepipe or sand control screen. Flow pipe 92 is surrounded by a gravel pack 94 to limit the axial flow of fluid along the outside of flow pipe 92. In the exemplary system illustrated, gravel pack 94 is disposed in a single reservoir production zone, and fluid flow into flow pipe 92 is controlled at a plurality of unique axial positions along flow pipe 92 within the single zone. However, the system 90 also may be adapted to multiple reservoir zones with other types of axial flow inhibiting mechanisms.

One type of flow control system 90 comprises a plurality of valve systems 96 disposed along flow pipe 92 in an axial direction, as illustrated in FIG. 5. Depending on the surrounding environment and the desired flow characteristics, each valve system 96 can be selected to regulate flow according to a variety of techniques. For example, each valve system can be a self-regulating system, such as the system described above, or each system can be selectively controllable. Additionally each valve system 96 may be designed, for example, to maintain a substantially constant pressure drop between the reservoir/formation 20 and an interior of flow pipe 92, or each valve system may be designed to regulate the flow rate of fluid moving into the interior of flow pipe 92. With selectively controllable valve systems 96, signals to and from each valve system are carried along one or more communication lines 98.

Figure 6:
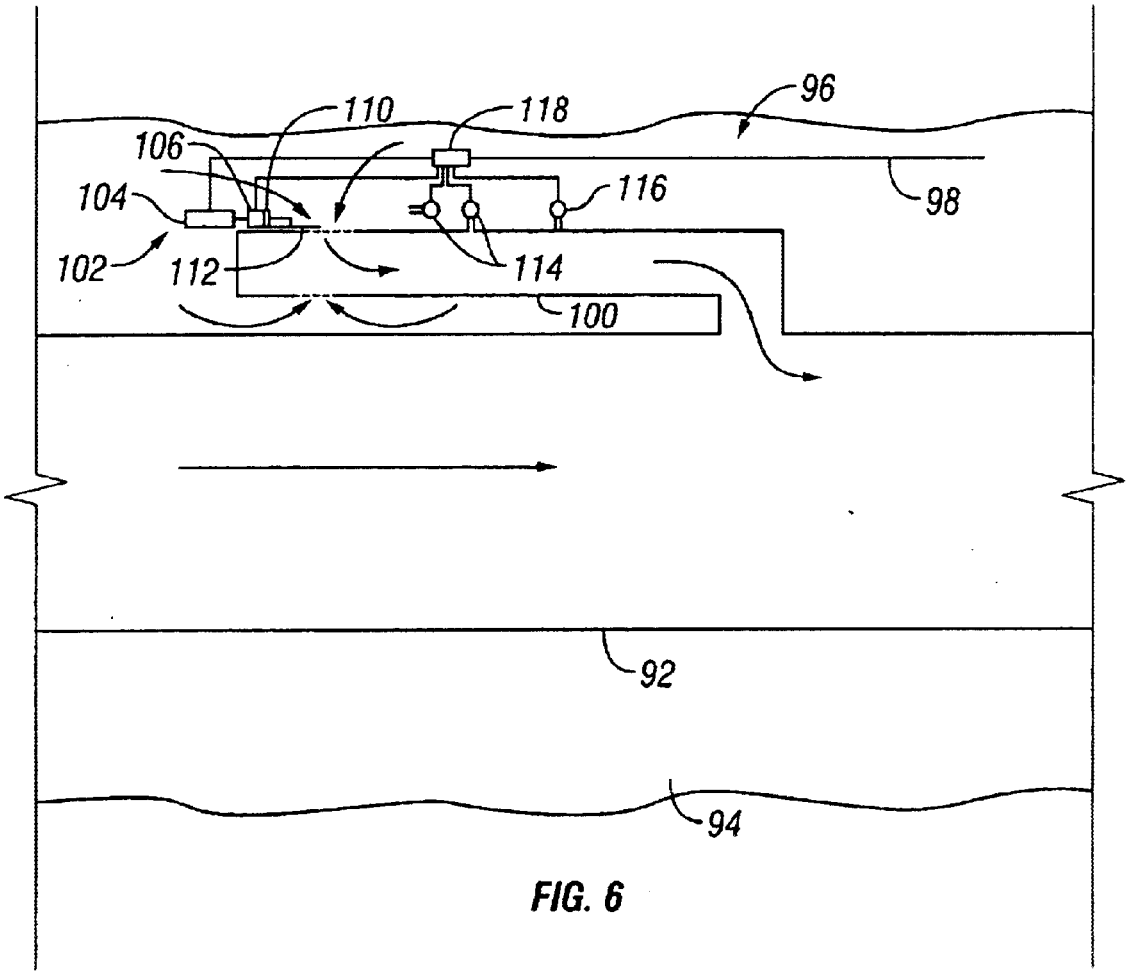
FIG. 6 is an illustration of an exemplary controlled valve system illustrated in FIG. 5.

One example of a controllable valve system 96 is illustrated in FIG. 6. The system has a flow passage member 100 to which an electrical flow control valve 102 is coupled. In this example, flow control valve 102 comprises an electric motor 104, a gear box 106, a position sensor 110 and an adjustable valve 112. Adjustable valve 112 is formed as a sliding sleeve valve, but other types of control valves, such as those discussed below, can be incorporated into the design.

The valve system 96 further comprises a pressure sensor that, for example, may be a differential pressure sensor or two absolute pressure sensors used to determine a pressure differential. Additionally, a density meter 116 may be coupled to the interior of flow passage member 100. The components of electrical flow control valve 102 as well as pressure sensor 114 and density meter 116 are electrically coupled to a controller 118. In this example, controller 118 receives electrical feedback from pressure sensor 114 and density meter 116 as well as position sensor 110. Based on these inputs, the pressure drop between the exterior and interior of flow passage member can be sensed and the flow can be adjusted based on selectively changing the pressure drop. One or more communication lines 98 are utilized to connect valve systems 96 to each other and/or to an overall monitoring and control system. It should be noted that the actual controller potentially can be located downhole or at a surface or other location.

Figure 7:
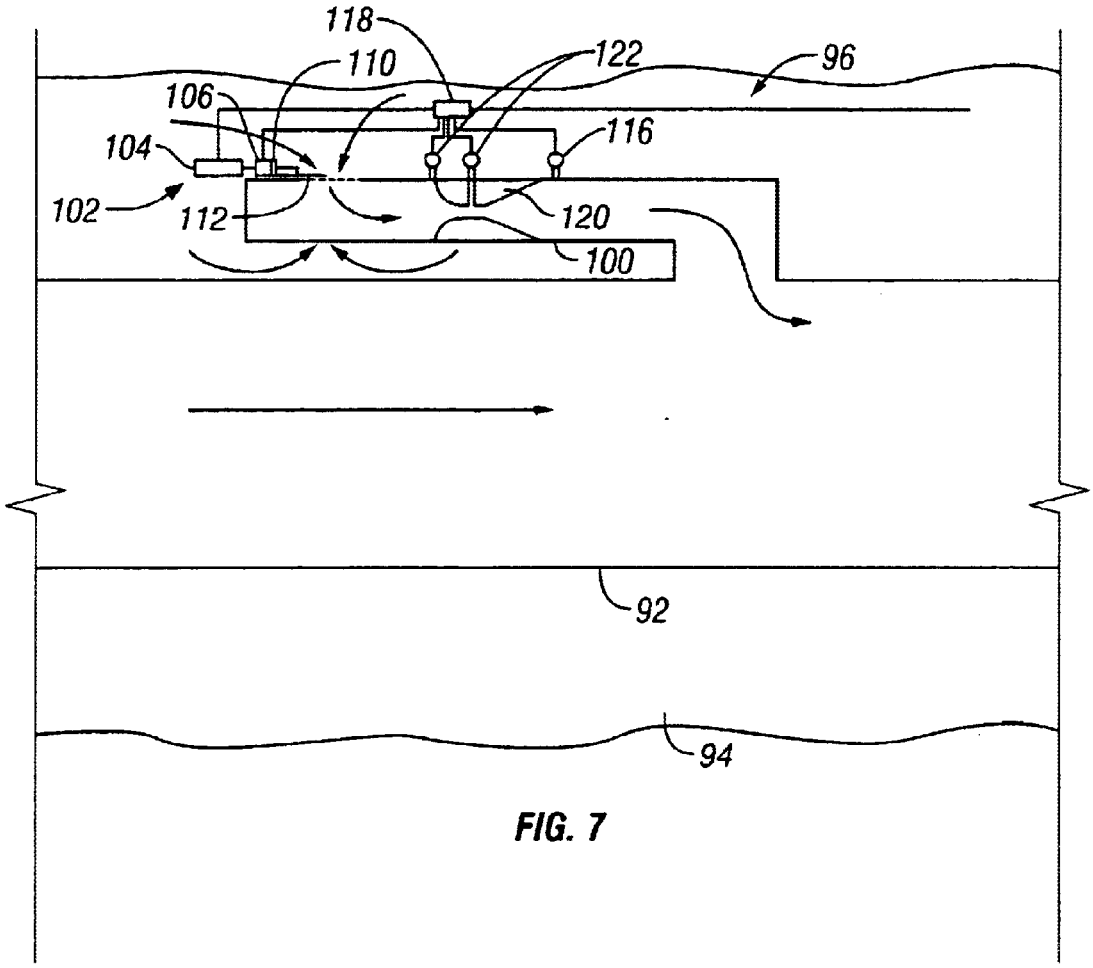
FIG. 7 is an alternate embodiment of the controlled valve system illustrated in FIG. 6.
Figure 8A:
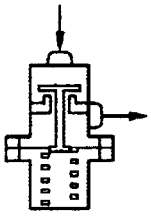
FIG. 8 is an illustration of some of the pressure regulating devices that can be incorporated into the overall flow control system.
Figure 8B:
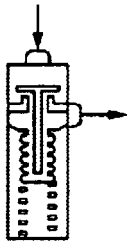
Figure 8C:
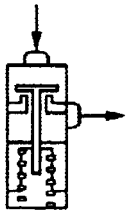
Figure 8D:
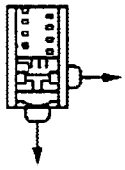
Figure 8E:
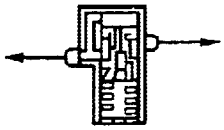
Figure 8F:
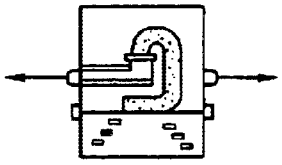
Figure 8G:
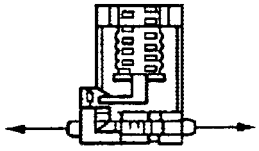
Figure 8H:
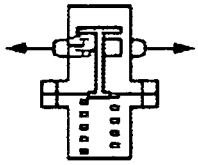
Figure 8I:
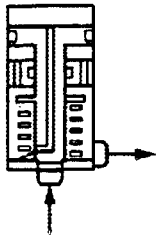
Figure 8J:
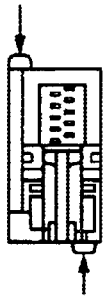
Figure 9A:
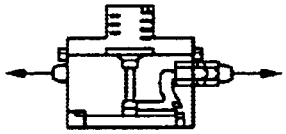
FIG. 9 illustrates a variety of flow rate controlling devices that can be incorporated into the overall flow control system.
Figure 9B:
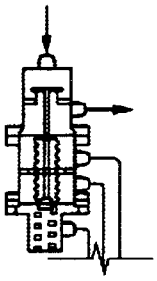
Figure 9C:
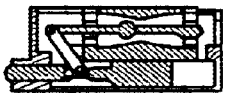
Figure 9D:
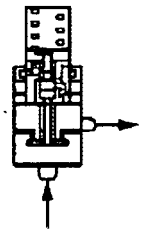
Figure 9E:
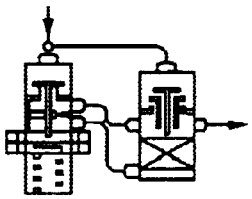
Figure 9G:
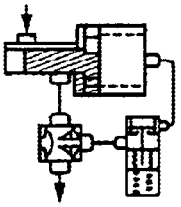
Figure 9F:
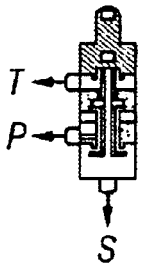

Another exemplary embodiment of a valve system 96 is illustrated in FIG. 7. In this embodiment, many of the components are the same as those discussed with reference to FIG. 6 have been labeled accordingly. However, a venturi 120 has been created within flow passage member 100. Thus, instead of measuring the pressure differential between locations internal and external to flow passage member 100, a pressure differential is measured at two locations within flow passage 100 to determine flow rate. As with the design illustrated in FIG. 6, a differential pressure sensor or two absolute pressure sensors can be used. In the latter approach, the pressures are subtracted from one another to obtain the pressure differential. With either style of pressure sensor, pressure is measured at a location within the throat of venturi 120 and at a location upstream from venturi 120. This pressure differential combined with the size parameters of the venturi can be used to determine flow rate and any changes in flow rate. Accordingly, this feedback is provided to controller 118 to permit appropriate adjustment at electrical flow control valve 102.

Although a sliding sleeve valve is indicated, a variety of valves may be incorporated into the overall flow control system either substantially on the interior or exterior of the flow pipe. In FIG. 8, a variety of pressure regulating devices are schematically illustrated and labeled A–J. In this exemplary group, device A is a diaphragm valve; device B is a bellows valve; device C is a piston valve; devices D and E are slide-type valves; device F is a pressure opening valve; device G is a streamlined valve; device H is an annular valve seat style device; and devices I and J are differential piston valves.

Additionally, a variety of flow regulating valves also can be incorporated into the system and typically rely on feedback from sensors or other devices that permit them to control the flow rate. Some exemplary styles of flow regulating devices are illustrated in FIG. 9 and labeled A–G. The exemplary device A is a differential diaphragm; device B is a valve with auxiliary chambers; device C is a flow restricting valve; device D is a pilot operated valve; devices E and F are relay operating valves; and device G is an S pressure flow regulating valve. The schematic illustrations in FIGS. 8 and 9 are examples of a few of the types of valves that can be incorporated into a given flow control system depending on desired characteristics of the system and environmental constraints.

It should be understood that the foregoing description is of exemplary embodiments of this invention, and that the invention is not limited to the specific forms shown. For example, the control system may be utilized in a variety of deviated wells; the flow pipe may be made in various styles, lengths, diameters and with various functionality; differentials of the control systems can be located downhole or at the surface; the flow pipe may be used with a variety of tools and instrumentation; and one or more valve styles may be used in a given flow control system. These and other modifications may be made in the design and arrangement of the elements without departing from the scope of the invention as expressed in the appended claims.

What is claimed is:

1. An apparatus for controlling fluid production in a horizontal wellbore, comprising:

a flow pipe the interior of which is in hydraulic communication with the earth's surface, the flow pipe disposed in a substantially horizontal portion of the wellbore; and a plurality of flow control valves disposed at spaced apart positions along the length of the flow pipe, each of the valves providing hydraulic communication between the interior of the flow pipe and a fluid reservoir in an earth formation, each of the valves adapted to maintain a substantially constant pressure drop between the reservoir and the interior of the flow pipe, wherein each flow control valve comprises a pair of pistons actuated against a biasing mechanism by fluid flow from the reservoir, the pair of pistons being adapted to cause closure of a port in hydraulic communication with the interior of the flow pipe when actuated against the biasing mechanism by the fluid flow.

2. The apparatus as defined in claim 1 wherein the flow pipe comprises a production tubing.

3. The apparatus as recited in claim 1 wherein the flow pipe comprises a gravel pack screen.

4. A method for controlling production from a reservoir into a deviated wellbore therethrough, comprising:

permitting fluid flow from the reservoir into a flow pipe disposed within the deviated wellbore at axial positions along the length of the flow pipe; and selectively controlling the fluid flow at each of the axial positions by a pressure balancing device having a piston and a secondary piston that move upon changes in pressure differential.

5. The method as recited in claim 4 wherein selectively controlling comprises maintaining a substantially constant pressure drop between an exterior and an interior of the flow pipe.

6. The method as recited in claim 5, wherein maintaining comprises measuring the substantially constant pressure drop.

7. The method as recited in claim 4, wherein selectively controlling comprises measuring the flow rate at each axial position.

8. The method as recited in claim 7, wherein selectively controlling comprises adjusting the flow rate at each axial position.

9. The method as recited in claim 4, wherein permitting comprises deploying a plurality of valves along the flow pipe at the axial positions.

10. The method as recited in claim 4, further comprising orienting the flow pipe generally horizontally within the reservoir.

11. A system for reducing coning effects along a deviated wellbore within a formation, comprising:

a flow pipe disposed within the deviated wellbore to receive a fluid from the formation; and a flow control system coupled to the flow pipe, the flow control system being adaptable to selectively control and adjust flow of the fluid from the formation into the flow pipe at a plurality of unique axial locations within a single production zone by a plurality of valves, each valve having a piston and a secondary piston that move upon changes in pressure differential.

12. The system as recited in claim 11, wherein each valve is adjustable by an electric motor to change flow rate.

13. The system as recited in claim 11, further comprising at least one sensor coupled to the flow passage member to detect a fluid characteristic as fluid passes through the flow passage member.

14. The system as recited in claim 13, wherein each of the plurality of valves is configured to maintain a substantially constant pressure drop between the formation and an interior of the flow pipe.

15. The system as recited in claim 14, wherein the flow pipe is generally horizontal within the formation.

16. The system as recited in claim 13, wherein the flow pipe comprises a production tubing.

17. The system as recited in claim 13, wherein the flow pipe comprises a sandscreen.

18. The system as recited in claim 11, wherein the plurality of valves is disposed at least substantially exterior of the flow pipe.

19. The system as recited in claim 11, wherein the plurality of valves is disposed at least substantially interior of the flow pipe.

20. The system as recited in claim 11, wherein the flow pipe is generally horizontal within the formation.

21. The system as recited in claim 11, wherein the plurality of valves are self regulating.

22. The system as recited in claim 11, wherein each valve of the plurality of valves comprises a spring biasing a movable member against an inflow of fluid.

23. The system as recited in claim 11, wherein the plurality of valves are electrically coupled and selectively controllable to regulate fluid flow therethrough.

24. The system as recited in claim 23, wherein each of the plurality of valves comprises a flow regulating valve with an electronic feedback.

25. A system for controlling production from a reservoir into a deviated wellbore therethrough, comprising:

means for permitting fluid flow from the reservoir into a flow pipe disposed within the deviated wellbore at axial positions along the length of the flow pipe;

means for selectively controlling the fluid flow at each of the axial positions with a pair of pistons actuated against a biasing mechanism by fluid flow from the reservoir, the pair of pistons being adapted to cause closure of a port in hydraulic communication with the interior of the flow pipe when actuated against the biasing mechanism by the fluid flow; and means for measuring fluid parameters in a flow passage independent of the flow pipe.

26. The system as recited in claim 25, wherein the means for permitting comprises openings in the flow pipe.

27. The system as recited in claim 26, wherein the means for selectively controlling comprises a plurality of valves.

28. The system as recited in claim 27, wherein the means for selectively controlling comprises a plurality of sensor to provide electronic feedback.

29. The system as recited in claim 28, wherein the plurality of sensors determine a pressure drop at each axial position.

30. The system as recited in claim 28, wherein the plurality of sensors determine flow rate at each axial position.

31. The system as recited in claim 28, wherein the means for selectively controlling comprises at least one controller electrically coupled to the plurality of sensors and the plurality of valves.

* * * * *